United States Patent [19]

Englund et al.

[11] 4,167,345

[45] Sep. 11, 1979

[54] PRINTING APPARATUS WITH SELECTIVELY MOVABLE PRINTING HEADS

[75] Inventors: Cösta R. Englund, Stockholm; Karl T. Wincent, Upplands Vasby, both of Sweden

[73] Assignee: Svenska Kassaregister AB, Sundbyberg, Sweden

[21] Appl. No.: 815,705

[22] Filed: Jul. 14, 1977

[30] Foreign Application Priority Data

Aug. 11, 1976 [SE] Sweden ..... 7608992

[51] Int. Cl.[2] ..... B41J 15/22

[52] U.S. Cl. ..... 400/588; 400/82; 400/95; 400/236.1; 400/320; 400/322; 400/328; 400/545; 400/570; 400/593

[58] Field of Search ..... 197/1 R, 5, 7, 90, 114 A, 197/114 B, 114 R, 126 A, 126 B, 126 R, 129, 132, 120, 133 R, 133 A, 133 F, 133 P, 133 T, 151, 178

[56] References Cited

U.S. PATENT DOCUMENTS

| | | | |
|---|---|---|---|
| 1,108,619 | 8/1914 | Poland | 197/133 R |
| 1,241,026 | 9/1917 | Sampson | 197/114 A |
| 1,278,475 | 9/1918 | Ireland | 197/133 P |
| 1,960,175 | 5/1934 | Stevens | 197/133 R |
| 2,160,539 | 5/1939 | Clark | 197/132 |
| 2,500,537 | 3/1950 | Von Duyke | 197/133 R X |
| 3,171,530 | 3/1965 | O'Daniel et al. | 197/151 |
| 3,333,670 | 8/1967 | Yazejian et al. | 197/114 R |
| 3,787,884 | 1/1974 | Demer | 197/133 R X |
| 3,825,681 | 7/1974 | Cederberg et al. | 197/1 R X |
| 3,863,749 | 2/1975 | Perry et al. | 197/151 |
| 3,910,396 | 10/1975 | Eischen et al. | 197/5 |
| 3,951,252 | 4/1976 | Selke et al. | 197/133 A |
| 3,986,594 | 10/1976 | Kondur | 197/1 R X |
| 4,027,765 | 6/1977 | Crump et al. | 197/133 R |
| 4,061,219 | 12/1977 | Nishikawa et al. | 197/151 X |

FOREIGN PATENT DOCUMENTS

| | | | |
|---|---|---|---|
| 2309071 | 9/1973 | Fed. Rep. of Germany | 197/1 R |

*Primary Examiner*—Ernest T. Wright, Jr.
*Attorney, Agent, or Firm*—Christel & Bean

[57] ABSTRACT

Apparatus for printing characters on at least one data carrier comprising a printing head movable along the data carrier, a line advance device for feeding the data carrier substantially perpendicular to the moving direction of the printing head, an ink ribbon feed mechanism for feeding an ink ribbon in relation to the data carrier, a cut-off mechanism for cutting off the data carrier, and a shaft rotatable less than 360° in one direction by a reversible motor from a home position to an end position determined by the selected operation cycle and thereafter back to the home position by reversing the direction of rotation of the shaft. The reversal of the shaft is performed at different times during subsequent operation cycles to permit gears and cams on the shaft to move the printing head to positions determined by the number of characters to be printed on the data carrier, actuation of the line advance device, and actuation of the ink ribbon feed mechanism or cut-off mechanism. A unit for printing normally unchanging information is activated in response to the motor providing a short backing movement before operation of the cut-off mechanism and before the printing head is moved from the normal neutral position.

10 Claims, 5 Drawing Figures

PRINTING APPARATUS WITH SELECTIVELY MOVABLE PRINTING HEADS

Figure 1:
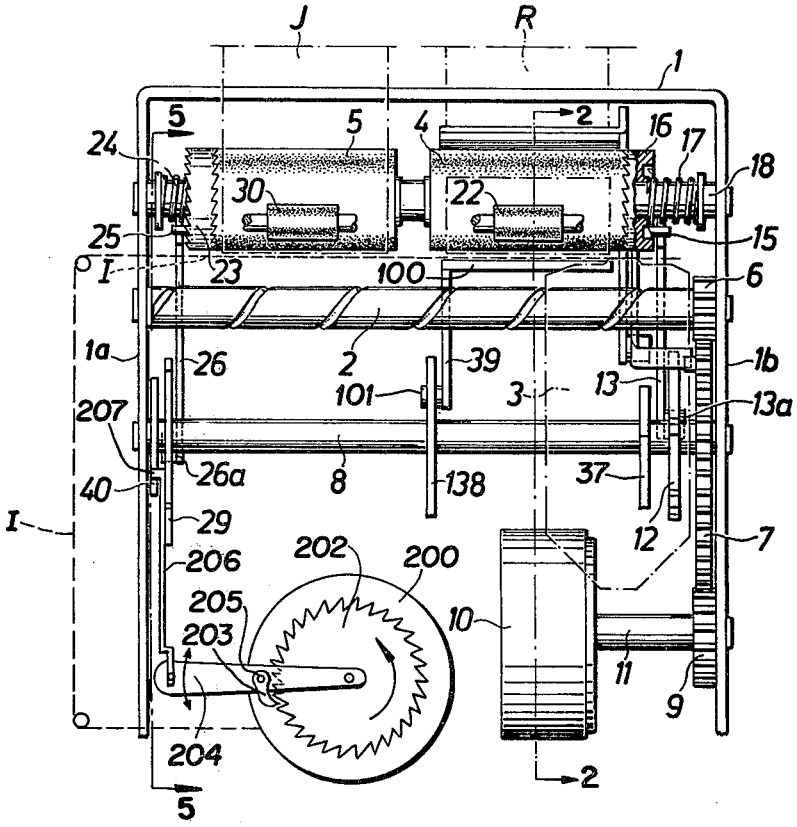

The present invention relates to a printing apparatus for printing characters on at least one and preferably two data carriers. The printing apparatus comprises a printing head which is moveable in two opposing directions along a platen supporting a data carrier or carriers, and in one direction printing rows of characters on the data carrier or carriers. The printing apparatus is especially suitable for use in electronic cash registers and is then actuated by electrical signals transmitted by the cash register for carrying out different printing sequences.

Printing apparatuses intended for electronic cash registers are usually so designed that a printing head moveable over a receipt tape begins the printing of digits on it, in compliance with output signals from the cash register, in the position for the most significant digit, i.e. the printing head is shifted over the tape from a neutral position to the left of it and prints during this movement the most significant digit first, thereafter the digit which has the next highest significance, etc. until the least significant digit has been printed. Thereafter the printing head is returned to its left-hand neutral position without performing any printing. If an audit tape is arranged by the side of the receipt tape as is shown in the U.S. Pat. No. 3,910,396, the printing head must be moved over both tapes even if only one tape is to be printed, or at least be moved over the whole width of one of the tapes, even if only one character is to be printed on the tape. Even if the travelling speed of the head is great, it will be seen that time is wasted since the printing head is inactive during a large portion of its movement in the printing direction in the case where only a few digits are printed on the tape.

Printing apparatuses are also known (see the German Offenlegungsschrift No. 2,309,071) comprising a printing head which begins its printing movement in position for the least significant digit, i.e. the printing head is moved over a data carrier from a neutral position to the right of it and prints the least significant digit first during this movement, thereafter the digit which has next lowest importance, etc., until the most significant digit has been printed. Thereafter the printing head is returned to its right-hand neutral position by a helical return spring without printing anything.

The printing head in the German Offenlegungsshrift No. 2,309,071 is intended to print alpha-numerical characters on a single data carrier. If a further data carrier is arranged by the side of the first one, and the printing head is allowed to move over both data carriers to carry out printing on them, the data carrier farthest away in the printing direction would always need to be passed over even if only the data carrier foremost in the printing direction were the one to be printed, since the device lacks means for suspending printing and returning the printing head immediately after the one data carrier has been printed, and immediately after the other data carrier has been printed.

With the printing apparatus according to the present invention, printing is carried out in the quickest possible way, independent of whether only the receipt tape or only the audit tape is printed or the receipt as well as the audit tape are printed. This is done by means of a reversible electric motor driving the printing head in a first operation cycle to print a predetermined number of characters on the receipt tape, which is situated foremost in the printing direction. After the printing head has travelled a distance proportional to the predetermined number of characters, rotation of the motor is reversed to return the printing head to its neutral position to the right of the receipt tape. The audit tape, which is only printed during certain operation cycles, is situated after the receipt tape in the printing direction, and the printing head passes and possibly prints a predetermined number of characters on the receipt tape before it prints a predetermined number of characters on the audit tape. After the audit tape has been printed, i.e. after the printing head has travelled a distance depending on the predetermined number of characters, the rotational direction of the motor is reversed and the printing head is returned to its neutral position to the right of the receipt tape.

In known printing apparatuses, the line shift or advance for a receipt and/or audit tape must be made with special line shift devices having electromagnets, which are separate from the driving mechanism for the printing head. Since these printing apparatuses also include inked ribbon feed mechanism, cut-off mechanism for the tape and/or tapes and/or a printing unit for providing a stereotype on the receipt tape, these must also be triggered separately by means of a device separate from said driving mechanism.

In known printing apparatuses, if such also include a printing unit for making a stereotype print on the receipt tape, this unit must also be triggered separately by means of a device, usually an electromagnet, which is separate from the device driving the printing head.

The object of the present invention is to provide a printing apparatus of the kind mentioned in the introduction, which circumvents the drawbacks pertaining to the devices in the prior art. The apparatus according to the invention carries out printing without unnecessary waste of time, and has only one driving means for driving the printing head as well as the different feeding, shifting and cutting-off devices for the data carrier and/or carriers and for triggering a printing unit for printing normally unchanging information, and the apparatus also comprises a minimum number of details for performing the different functions.

This and other objects have been achieved by the invention having been given the characterizing features disclosed in the patent claims.

Figure 2:
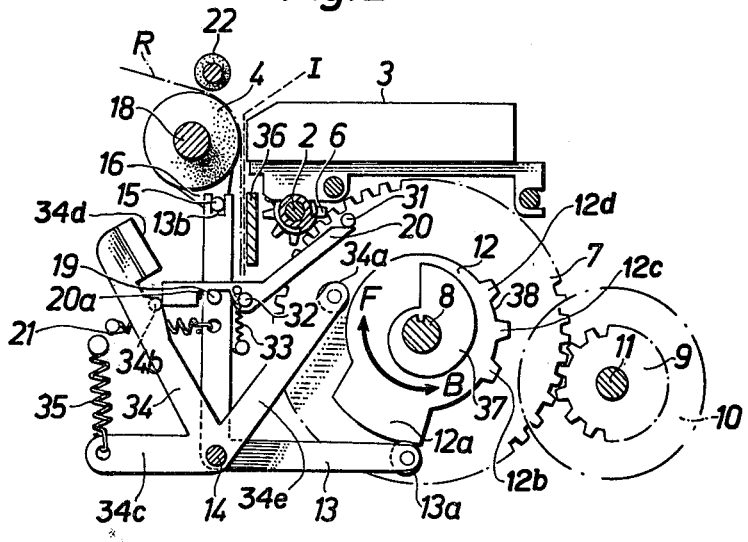
Figure 3:
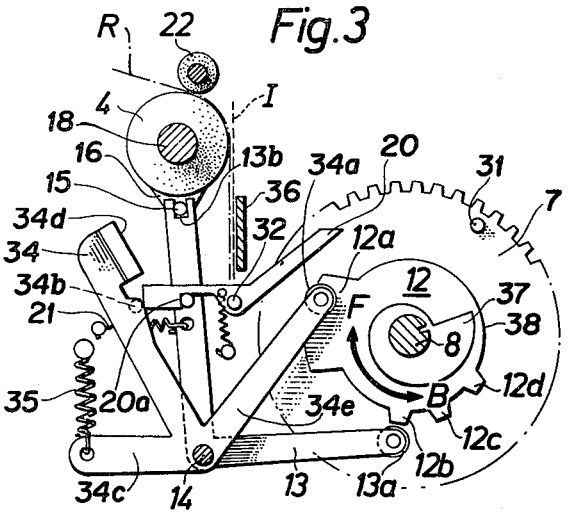
Figure 4:
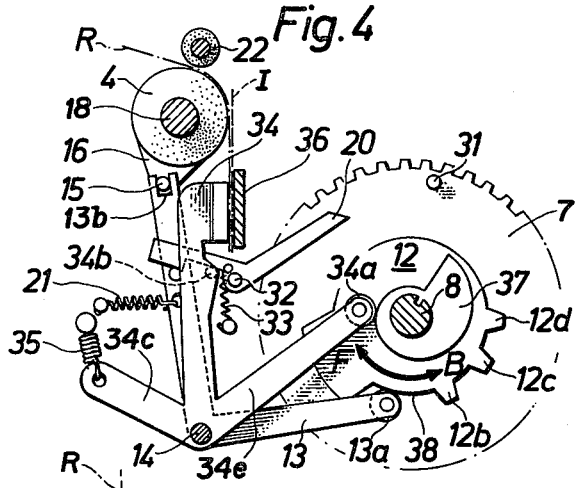
Figure 5:
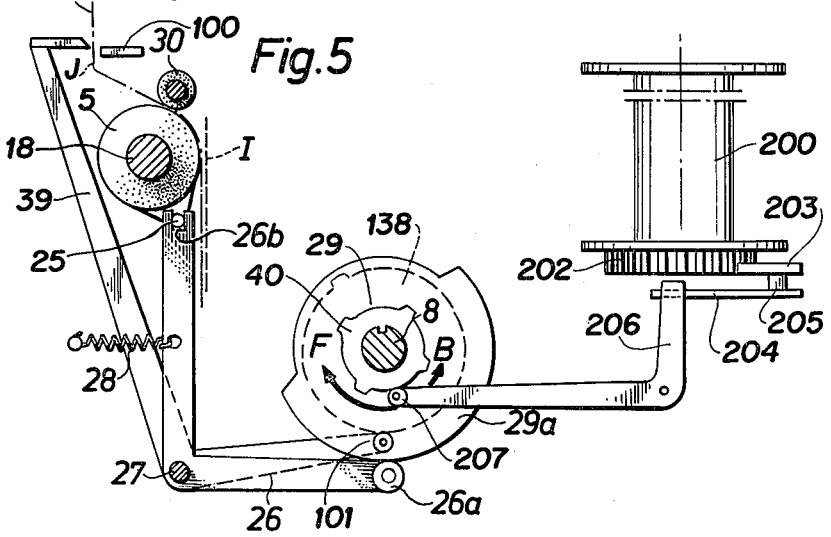

A preferred embodiment of the invention will now be described while referring to the appended drawing, on which FIG. 1 shows a plan view, seen from above, of the printing apparatus according to the invention;

FIG. 2 shows a side view of the apparatus according to FIG. 1 in a section along the line 2—2 in FIG. 1, FIGS. 3 and 4 are similar to FIG. 2 and show in other positions certain details incorporated in the apparatus in FIGS. 1 and 2, and FIG. 5 shows a section along the line 5—5 in FIG. 1.

In FIG. 1 the numeral 1 is used to denote the frame to which all the components of the apparatus are mounted. The frame 1 is intended to be fitted to a printing office machine such as an electronic cash register, and is provided with suitable attachments (not shown) for this purpose. A worm shaft 2, rotatably mounted in opposing end plates 1*a* and 1*b* of the frame 1, is in continuous engagement in a way known per se with a nut-like part (not shown) on the underside of a conventional mosaic printing head 3 and drives this reciprocally from the neutral position, shown in FIG. 1 by chain lines, along two platens 4 and 5. The worm shaft 2 is provided with a gear wheel 6 engaging with an intermediate gear wheel 7 of relatively large diameter. The intermediate gear wheel 7 is fixed to a shaft 8, rotatably mounted in the end plates 1*a* and 1*b*, and engages with a gear wheel 9 attached to a shaft 11, driven by a motor 10, the shaft 11 being rotatably mounted in the end plate 1*b*.

The motor 10, which is fixed to the frame 1, consists of a slow-speed reversible-rotation synchronous motor. Because of the low number of revolutions of the motor 10 and the ratio between the gear wheels 9, 7 and 6; the shaft 8 will be turned less than 360°, to return just as much during each operational cycle. For each forward or return travel of the printing head 3, the shaft 8 is actually turned a maximum of about 330° to enable the controlling actions and feeds, obtained via the cams 12, 29, 37, 40 and 138 attached to the shaft 8, during a maximum of one revolution of the shaft 8, which simplifies the construction of the apparatus. The ratio between the gear wheels 6 and 7 is selected so that the worm shaft 2 moves the printing head 3 forward and then back again over the platens 4 and 5, while the shaft 8 turns a maximum of about 330° forward and thereafter just as much back again to the starting position.

A cam 12 is attached to the shaft 8, and is provided with a hump or lobe 12*a* which, in a way described below, controls the line shift or feed of the data carrier, in this case consisting of a receipt tape R, which bears against the platen 4.

In the neutral position of the printing head 3, shown in FIGS. 1 and 2, a roller follower 13*a* rides against the hump 12*a*, the follower 13*a* being mounted on the free end of the horizontal arm of a bell crank lever 13, which is fixed to a shaft 14 pivotally mounted in the end plate 1*b*. The free end of the vertical arm of the bell crank lever 13 is provided with a recess 13*b*, which engages with a pin 15 on a ratchet wheel 16, the teeth of the ratchet wheel 16 coacting with corresponding teeth formed on the right-hand end wall of the platen 4. The ratchet wheel 16 is biassed to the left in FIG. 1 by a compression spring 17. The spring 17 is wound round a shaft 18, fixed to the end plates 1*a* and 1*b*, the platens 4 and 5 and the ratchet wheel 16 being rotatably mounted on the shaft 18.

After the cam 12 has been turned a few degrees in the direction of the arrow F from the neutral position shown in FIG. 2, the follower 13*a* loses contact with the hump 12*a*, and by the action of a tension spring 21 on the upwardly directed arm of the bell crank lever 13, the lever 13 is swung anti-clockwise round the shaft 14 until a peg 19 on the lever 13 is brought into contact with a notch 20*a* on a latching arm 20, which normally assumes the latching position shown in FIG. 2. Anti-clockwise rotation of the bell crank lever 13 is thus limited by the latching arm 20, and the follower 13*a* will therefore not move down onto the low profile 38 of the cam 12, but will take up the position shown in FIG. 3 immediately above the path of movement for three humps 12*b*, 12*c* and 12*d*, the function of which will be described later. Swinging the bell crank lever 13 anti-clockwise causes the ratchet wheel 16, via the recess 13*b* and pin 15, to be turned clockwise round the shaft 18, whereon its teeth trip over the teeth of the platen 4 without turning it. The reason that the platen 4 is not turned by the ratchet wheel 16, when it rotates clockwise round the shaft 18, is partly due to the shape of the ratchet teeth, and partly because the friction between the platen 4 and the shaft 18 is relatively large.

The bell crank lever 13 thus does not cause any advance of the receipt tape R by swinging anti-clockwise round the shaft 14, this being a so-called fetching movement in preparation for advance.

When the motor 10 was started and began a forward rotation movement triggered by signals from circuits known per se in the electronic cash register, not only was the clockwise rotation of the shaft 8 started, to prepare advance of the receipt tape R, but turning of the worm shaft 2 (anti-clockwise in FIG. 2) was simultaneously begun. The anti-clockwise turning of the shaft 2 causes the printing head 3 to be shifted towards the left from the neutral position shown in FIG. 1 and into contact with the tape R, whereat it is provided with a row of characters, predetermined as to number. Since the printing head 3 is moved to the left over the tape R for printing, the least significant character in the information from the cash register will be printed first. In the case where the information consists of a sub-item giving the price of an article, hundredths of the currency are printed first, then tenths, then currency in units and then in tens and so on. The information intended for printing is obtained from electronic circuits known per se in the cash register, which transmit at predetermined times signals representing characters to the printing head 3 in the order they are to be printed on the receipt tape R.

The movement of the printing head 3 in the printing direction, and the clockwise direction of the shaft 8, continue until the predetermined number of characters in a row have been printed on the receipt tape R. In FIG. 3 the shaft 8 has been shown turned about 75° clockwise from the neutral position. As is apparent from this figure, the hump 12*a* has been separated from the follower 13*a*, but under no operation cycle will the hump 12*a* be removed so far from the follower 13*a* that the hump 12*a* once again contacts the follower 13*a* during clockwise turning of the shaft 8, since the maximum turning angle of the shaft 8 is about 330°.

After the predetermined number of characters in a row have been printed on the receipt tape R, the circuits in the cash register send a signal to the motor 10 to reverse its direction of rotation. The time for reverse thus depends on how many characters there are in the line printed on the receipt tape R. The fewer characters which are printed, the earlier reversal takes place, which means that the printing head 3 does not need to travel an unnecessarily long distance in the printing direction in the case where only a few characters are printed, which saves time.

On reversal, the direction of rotation for the shafts 11, 8 and 2 is reversed, the printing head 3 being taken by the shaft 2 to the neutral position on the right in FIG. 1, and the shaft 8 is turned backwards in the direction of the arrow B in FIG. 3. Some few degrees before the shaft 8 reaches its neutral position, the rear edge of the hump 12*a* meets the follower 13*a*, causing the bell crank lever 13 to swing clockwise round the shaft 14 and assume the position shown in FIG. 2. When the lever 13 is swung clockwise, it moves the pin 15 to the right via the recess 13*b*, the ratchet wheel 16 then being turned anti-clockwise from the position in FIG. 3 to the position in FIGS. 1 and 2, thereby turning the platen 4 because of the engagement between the ratchet teeth, so that it advances the receipt tape R between it and a pressure roller 22 a distance corresponding to the distance between two lines on the tape R. The advance of tape R thus takes place immediately before the printing head 3 has reached its neutral position and independently of the length of travel of the printing head 3 in the printing direction.

The printing head 3 is also intended to print rows of characters on a data carrier consisting of an audit tape J supported by the platen 5. However, printing characters on the audit tape J does not take place as often as on the receipt tape R, and usually only takes place when making up totals, i.e. when the sum of the cost of purchased goods is calculated by the cash register. In this case the same information is recorded on both tapes R and J. If there is no printing to be done on the audit tape J, printing on the receipt tape R is carried out in the way described previously, and the printing head 3 returns to the neutral position after the most significant character is printed on the receipt tape R. If, however, characters are also/only to be printed on the audit tape J, the printing head 3 continues its travel in the printing direction and is returned to the neutral position to the right in FIG. 1 only after the predetermined number of characters has been printed on the audit tape J. The time for returning the printing head 3 is determined by the circuits incorporated in the cash register, these circuits sending a signal to the motor 10 for reversing its direction of rotation when the predetermined number of characters have been printed in a line on the audit tape J.

At its left-hand end face, the platen 5 is provided with ratchet teeth coacting with ratchet teeth on a ratchet wheel 23, rotatably mounted on the shaft 18, this wheel 23 being pressed against the platen 5 by means of a spring 24 wound round the shaft 18. As is apparent from FIG. 5, there is a pin 25 on the ratchet wheel 23, accommodated in a recess 26*b* in the free end of the upstanding arm of a substantially bell crank-like lever 26, pivotally mounted on a shaft 27, provided with a cam follower 26*a* at the free end of its substantially horizontal arm and biassed to swing anti-clockwise by means of a tension spring 28. The follower 26*a* engages against a hump 29*a* on a cam 29 attached to the shaft 8, the cam 29 assuming the position shown in FIG. 5 in the neutral position of the printing head 3. When the printing head 3 is moved in the printing direction from its neutral position, the follower 26*a* will not lose contact with the hump 29*a* as long as the distance from the neutral position is less than a distance substantially corresponding to the distance between the right- and left-hand ends of the platen 4. However, when printing is to be carried out on the audit tape J, and the printing head 3 approaches the platen 5, the follower 26*a* will contact the low profile on the cam 29, since the shaft 8 has been turned in the direction of the arrow F a distance corresponding to the movement of the printing head 3 between the neutral position and a position between the platens 4 and 5. The lever 26 consequently swings anti-clockwise around the shaft 27, and in a similar way as described hereinbefore in conjunction with the advance of the receipt tape R, it performs a waiting movement to prepare for advancing the audit tape J. When the printing head 3 has printed the predetermined number of characters on the audit tape J, the direction of rotation of the motor 10 is reversed and the shaft 8 is thus turned backwards in the direction of the arrow B in FIG. 5. When the follower 26*a* once again meets the hump 29*a*, which happens when the printing head 3 is between the platens 4 and 5, the lever 26 is given a clockwise swinging movement, causing the audit tape J to be advanced with the aid of the ratchet means 23–25, platen 5 and a pressure roller 30 a distance corresponding to the distance between two lines on it. Advance of the audit tape J takes place in the same way as previously described in conjunction with advance of the receipt tape R, no further description thereof being therefore required.

After the different sub-items and the total sum have been printed on the receipt tape R, this is cut off so that the customer shall have a receipt containing said information. Cutting-off is carried out by a cut-off means or device 100 known per se and actuated by a hump on a cam 138 attached to the shaft 8 via a follower 101 on a lever 39 operating the cut-off device 100. Before cutting off, unchanging information, e.g. the name of the shop in which the cash register is situated, is also normally printed on the receipt tape R. According to the invention, such printing takes place in the same operation cycle during which the total sum is printed on the receipt tape R, the receipt tape R being advanced a distance corresponding to a plurality of spaces between two adjacent printing lines on it, so that the unchanging information will have room on the receipt tape R which is later cut off.

When a totalling operation is to be carried out, the circuits incorporated in the cash register send a signal to the motor 10 to start backward rotation. This backward rotation causes the printing head 3 to be moved a short distance to the right from the neutral position in FIG. 1, and the shaft 8 to be rotated a small amount anti-clockwise (about 10°) in the direction of the arrow B in FIG. 2. A pin 31 fixed to the gear wheel 7 then meets the bevelled-off right-hand end of the latching arm 20 to turn the arm 20 clockwise, about a shaft 32 attached to the frame 1, against the action of a tension spring 33, one end of which is attached to the latching arm 20 and the other to the frame 1. The left-hand end of the latching arm 20 is thereby moved upwards and releases a striker 34 via a pin 34*b* on it, so that the striker 34 can turn clockwise round the shaft 14, on which the striker 34 is pivotally mounted. The clockwise movement of the striker 34 is provided by a heavy tension spring 35 mounted between the frame 1 and an arm 34*c* on the striker 34. At the end of this movement, a pad 34*d* on the striker 34 presses against a printing block or stereotype 36 to print the unchanging information on the receipt tape R situated between the printing block 36 and the pad 34*d* on the striker 34.

After the motor 10 has rotated the shaft 8 backwards about 10°, the circuits in the cash register send a signal to the motor 10 to reverse its direction of rotation, causing the shaft 8 to be turned in the direction of the arrow F. When the shaft 8 passes the neutral position shown in FIG. 2, the spring 33 attempts to return the latching arm 20 to the position shown in this figure, since the pin 31 no longer actuates the right-hand end of the arm 20, but the arm 20 cannot be returned since the pin 34*b* on the striker 34 engages against the underside of the left-hand part of the arm 20 and prevents the arm 20 being swung clockwise around the shaft 32. On passing the neutral position, a cam 37 attached to the shaft 8 begins to actuate the cam follower 34*a* attached to an arm 34*e* on the printing striker 34 to return the striker 34 to its neutral position shown in FIG. 2. FIG. 4 shows the situation after the shaft 8 has been first turned backwards about 10°, and thereafter forwards in the direction of the arrow F about 30° from the neutral position, where the cam 37 has begun returning the striker 34 to the position shown in FIG. 3. Return is completed after about 260° rotation of the shaft 8 from the neutral position.

The swinging of the latching arm 20 clockwise around the shaft 32 caused by the pin 31, which took place when the shaft 8 was rotated about 10° in the direction of the arrow B from the neutral position in FIG. 2, also resulted in the pin 19 on the bell crank lever 13 being released for movement to the left in FIG. 2. In spite of this release, the lever 13 cannot be swung clockwise around the shaft 14 by the spring 21 from the position shown in FIG. 2, before the shaft 8 is turned in the direction of the arrow F far enough for the follower 13*a* to be separated from the hump 12*a*, which takes place some few degrees from this position. However, when the hump 12*a* is taken out of contact with the follower 13*a*, the follower 13*a* will be taken down onto the low profile 38 of the cam 12, whereby the lever 13 will be moved to the position shown in FIG. 4 by the spring 21. The latching arm 20 does not prevent this turning movement by the lever 13 since, as mentioned above, the pin 34*b* on the striker 34 prevents return of the latching arm 20 up until the anti-clockwise return of the striker 34 from the position shown in FIG. 4 is nearly completed.

The anti-clockwise swing of the lever 13 about the shaft 14 from the position shown in FIG. 2 to that shown in FIG. 4 results in the ratchet wheel 16 carrying out as fetching movement which is approximately double the fetching movement carried out by the ratchet wheel 16 when the lever 13 was swung from the position shown in FIG. 2 to that shown in FIG. 3. When the shaft 8 continues to turn in the direction of the arrow F from the position shown in FIG. 4 and the follower 13*a* is forced up onto the hump 12*b*, the lever 13 will turn the ratchet wheel 16 anti-clockwise in FIG. 4 an angle corresponding to the angle the ratchet wheel 16 was turned through when the receipt tape R was advanced a distance corresponding to the distance between two lines of characters, since the height of the hump 12*b* is about half the height of the hump 12*a*, and the receipt tape R will therefore be advanced a distance approximately corresponding to the distance between two lines on it. When the follower 13*a* leaves the hump 12*b* on continued rotation of the shaft 8, the lever 13 once again carries out a fetching movement and the receipt tape R is further advanced a space (line) when the follower 13*a* is forced up onto the hump 12*c*. Two further fetching movements are provided by the humps 12*c* and 12*d*, and an advancing movement (provided by the hump 12*d*) is carried out before the shaft 8 has terminated its rotation in the direction of the arrow F. When the last hump 12*d* has passed the roller 13*a* in the direction of the arrow F, return of the striker 34 via the cam 37 has continued so far that the pin 34*b* releases the lower left-hand face of the latching arm 20 so that the latching arm 20 can be turned anti-clockwise by means of the spring 33, from the position in FIG. 4 to the position in FIG. 2, where its left-hand end face latches the striker 34 against clockwise rotation round the shaft 14, when the follower 34*a* leaves the higher profile of the cam 37 and where the notch 20*a* in the lower left-hand portion of the latching arm 20 limits the clockwise turn of the lever 13 to the position shown in FIG. 4 via the pin 19.

When the shaft 8 has turned less than one revolution in the direction of the arrow F, the receipt tape R has thus been advanced a distance corresponding to three times the distance between two adjacent lines on it, the distance being sufficient for the print resulting from the tape R being pressed against the printing block 36 by the pad 34*d* on the striker 34 to remain in its entirety on the receipt tape R when the latter is cut from the tape R via the cut-off device 100 controlled by the shaft 8. On the subsequent change in direction of rotation of the motor 10, the shaft 8 is turned backwards in the direction of the arrow B until the different components have assumed the positions shown in FIG. 2.

In order that the tapes R and J can be provided with print, inked ribbons must be arranged between them and the respective printing device. Such an inked ribbon I is shown schematically in the figures, the ribbon I extending over both platens 4 and 5 and having a width which is somewhat greater than the distance between the lower edge of the printing block 36 and the center of the shaft 18, to service all the printing areas incorporated in the apparatus. The inked ribbon I is advanced in one of both the directions of movement of the printing head 3 by a conventional advancing mechanism or ink ribbon feed means 200,202,203,204,205, which is actuated during each operation cycle by a cam 40 attached to shaft 8, via a lever 206 having a follower 207 engaging the cam 40.

Although a sole embodiment of the invention has been described above and shown on the drawing, it should be understood that the invention is not limited to this embodiment but is only limited by the disclosures in the following patent claims.

We claim:

1. An apparatus for printing characters on at least one data carrier, comprising a printing head movable along the data carrier, line advance means for feeding the data carrier substantially perpendicular to the moving direction of the printing head, and at least one of an ink ribbon feed means for feeding an ink ribbon in relation to the data carrier and a cut-off means for cutting off the data carrier, characterized by a shaft (8) rotatable less than 360° in one direction by a motor (10) from a home position to an end position determined by the selected operation cycle and thereafter back to the home position again reversing the direction of rotation of the shaft, the reversal of the direction of rotation of the shaft being performed at different points of time during subsequent operation cycles to permit motion transmitting means (7; 12; 29; 37; 40) on the shaft to move the printing head to positions determined by the number of characters to be printed on the data carrier, actuation of the line advance means, and actuation of at least one of the ink ribbon feed means and cut-off means.

2. An apparatus as claimed in claim 1, characterized in that the direction of rotation of the shaft (8) is reversible by reversing the direction of rotation of the motor (10).

3. An apparatus as claimed in claim 1, characterized in that the shaft (8) actuates the line advance means (13-17, 4, 22; 23-28, 5, 30) after the printing head (3) has travelled a short distance over the data carrier in the printing direction, to prepare advance of the data carrier (R; J) and on movement of the printing head in the opposite direction to carry out said advance independent of the printing head travel in the printing direction.

4. An apparatus as claimed in claim 1, characterized in that the motion transmitting means (7; 12; 29; 37; 40) supported by the shaft (8) comprise a cam (12; 29) attached to the shaft, and coacting with a lever (13; 26) provided with a cam follower, said lever being coupled to a ratchet means (4, 16, 17; 5, 23, 24) coacting with a platen (4; 5), there being a profile (12*a*; 29*a*) on the cam arranged to act on the follower when the cam is turned a short distance in a first direction from the neutral position of the shaft, the lever in turn actuating the ratchet means to carry out a fetching movement without turning the platen and whereat the cam, independent of how far the cam has been turned in the first direction, on turning in the opposite direction actuates the cam follower with lever, which in turn actuates the ratchet means to turn the platen and thereby advance the data carrier (R; J) a distance corresponding to the space between two lines of characters thereon.

5. An apparatus as claimed in claim 4, characterized in that the cam (12; 29) is formed so that the rotation of the platen (4; 5) takes place a short distance before the shaft (8) reaches its neutral position.

6. An apparatus as claimed in claim 1, characterized in that the motion transmitting means (7; 12; 29; 37; 40) carried by the shaft (8) comprise cams (138, 40) controlling the advance of an inked ribbon (I) serving all printing locations and the cut-off means for cutting off the data carrier (R).

7. An apparatus as claimed in claim 1, characterized in that the shaft (8) carries means (7, 31) for triggering a printing unit (34, 36) which prints normally unchanging information on the data carrier (R).

8. An apparatus for printing characters on a first data carrier, comprising a printing head movable along the data carrier and a printing unit for printing normally unchanging information on at least one of the first data carrier and a second data carrier adjacent to the first data carrier, there being a sole driving means (10, 11, 9, 8, 7, 6, 2) for driving the printing head in two opposed directions along the first data carrier and for triggering the printing unit (34,36), the driving means comprising a motor (10), the direction of rotation thereof being reversible, and the triggering of the printing unit being performed by the motor carrying out a short backing movement before the printing head is moved from its normal neutral position.

9. A printing apparatus, comprising a printing head for printing alpha-numerical characters on a first data carrier and a printing unit separate from the printing head for printing normally unchanging information on at least one of said first data carrier and a second data carrier adjacent to said first data carrier, arranged on a platen, characterized by a sole driving means (10, 11, 9, 8, 7, 6, 2) for driving the printing head (3) in two opposing directions and for triggering the printing unit (34,36), and characterized further in that the driving means (10, 11, 9, 8, 7, 6, 2) includes a shaft (8) carrying a cam (37) actuating a cam follower (34*a*) coacting with the printing unit (34,36).

10. A printing apparatus, comprising a printing head for printing alpha-numerical characters on a first data carrier and a printing unit separate from the printing head for printing normally unchanging information on at least one of said first data carrier and a second data carrier adjacent to said first data carrier, arranged on a platen, characterized by a sole driving means (10, 11, 9, 8, 7, 6, 2) for driving the printing head (3) in two opposing directions and for triggering the printing unit (34,36), characterized further in that triggering the printing unit (34,36) actuates advancing means (12–17, 4, 24) coacting with the first data carrier (R) so that the advancing means advances the first data carrier a distance exceeding the distance between two lines of characters, and characterized further in that the driving means (10, 11, 9, 8, 7, 6,2) include a stop element (31) which at the backing movement of said driving means actuates a latch (20) triggering the printing unit (34,36) for printing and simultaneously releasing a first lever (13) with cam follower (13*a*) included in the advancing means (12, 17, 4, 22) of the first data carrier (R) so that the follower coacts with the profile on a cam (12) included in the advancing means, said profile being provided with at least two lobes (12*b*, 12*c*, 12*d*) which via the cam follower means (4, 16, 17) included in the advancing means for turning the platen (4) and thereby moving the first data carrier (R) a distance corresponding to at least double the distance between two lines of characters thereon.

* * * * *